US005379885A

United States Patent [19]

Chen

[11] Patent Number: 5,379,885

[45] Date of Patent: Jan. 10, 1995

[54] ROTARY TOOL CARRIER ASSEMBLY

[76] Inventor: Pi-Chi Chen, No. 1-1, Lai-Tsuo E. Lane, North Area, Taichung, Taiwan, Prov. of China

[21] Appl. No.: 135,535

[22] Filed: Oct. 13, 1993

[51] Int. Cl.[6] ..... B65D 85/24

[52] U.S. Cl. ..... 206/216; 206/338; 206/373; 211/70.6; 211/163

[58] Field of Search ..... 206/372, 373, 216, 338; 211/70.6, 78, 163

[56] References Cited

U.S. PATENT DOCUMENTS

| | | | |
|---|---|---|---|
| 1,232,923 | 7/1917 | Howeth | 211/70.6 |
| 4,953,696 | 9/1990 | Huang et al. | 211/78 |
| 5,183,165 | 2/1993 | Acona et al. | 211/163 |

FOREIGN PATENT DOCUMENTS

| | | | |
|---|---|---|---|
| 0811553 | 4/1969 | Canada | 211/163 |
| 2058548 | 4/1981 | United Kingdom | 211/163 |

*Primary Examiner*—Jimmy G. Foster
*Attorney, Agent, or Firm*—Bacon & Thomas

[57] ABSTRACT

A rotary tool carrier assembly includes a base having a ball race, and a tool carrier unit fastened to the base and revolvably supported on the ball race, the tool carrier unit being consisted of a bottom tool carrier supported on the ball race having upright stop rods and recessed holes and linked sloping cells for carrying different drill gimlets and tool bits and sockets, a top tool carrier having a plurality of tool hanging holes for hanging tools and tool storage chambers for keeping screws and nuts, and an upright support connected between the bottom tool carrier and the top tool carrier.

2 Claims, 4 Drawing Sheets

ROTARY TOOL CARRIER ASSEMBLY

BACKGROUND OF THE INVENTION

The present invention relates to a rotary tool carrier assembly which comprises a double-deck tool carrier unit revolvably supported on a base to carry a variety of drill gimlets, tool bits, hand tools, and sockets.

Various tool boxes have been known, and widely used for carrying a variety of tools and accessories. These tool boxes are practical in use for carrying tools and accessories from place to place, however, they are still not convenient in use in a job site while one is doing a repair or maintenance work. There is disclosed a kind of tool carrier, as shown in FIG. 1, designed for carrying tools and accessories in a job site. The tool carrier is made in a flat configuration having a center mounting hole, by which the tool carrier can be mounted on a bucket or the like, and a variety of slots for hanging different hand tools. This structure of tool carrier is suitable for hanging hand tools, but it has no storage spaces for keeping small accessories such as screws, nuts, tool bits, sockets, drill gimlets, etc. When in use, a bucket or a drum must be prepared to support the tool carrier in place. Because the tool carrier is not revolvably supported on a bucket or the like, it is still not convenient to pick up a specific item from the tool carrier far from the reach of the hand of the user being sitting and standing nearby the tool carrier.

SUMMARY OF THE INVENTION

The present invention has been accomplished to provide a rotary tool carrier assembly which eliminates the aforesaid disadvantages. According to one aspect of the present invention, the rotary tool carrier assembly is comprised of a base having a ball race at the top, and a tool carrier unit revolvably supported on the ball race above the base to carry a variety of hand tools, tool bits, drill gimlets, sockets, etc. According to another aspect of the present invention, the tool carrier unit is comprised of a top tool carrier, a bottom tool carrier, and an upright support connected between the bottom tool carrier and the top tool carrier, wherein the top tool carrier comprises a variety of hanging holes for hanging different hand tools and a plurality of storage chambers for keeping screws, nuts, etc.; the bottom tool carrier comprises a upright stop rods, linked sloping cells, and recessed holes for holding drill gimlets, tool bits, and sockets respectively.

DETAILED DESCRIPTION OF THE PREFERRED EMBODIMENT

Figure 1:
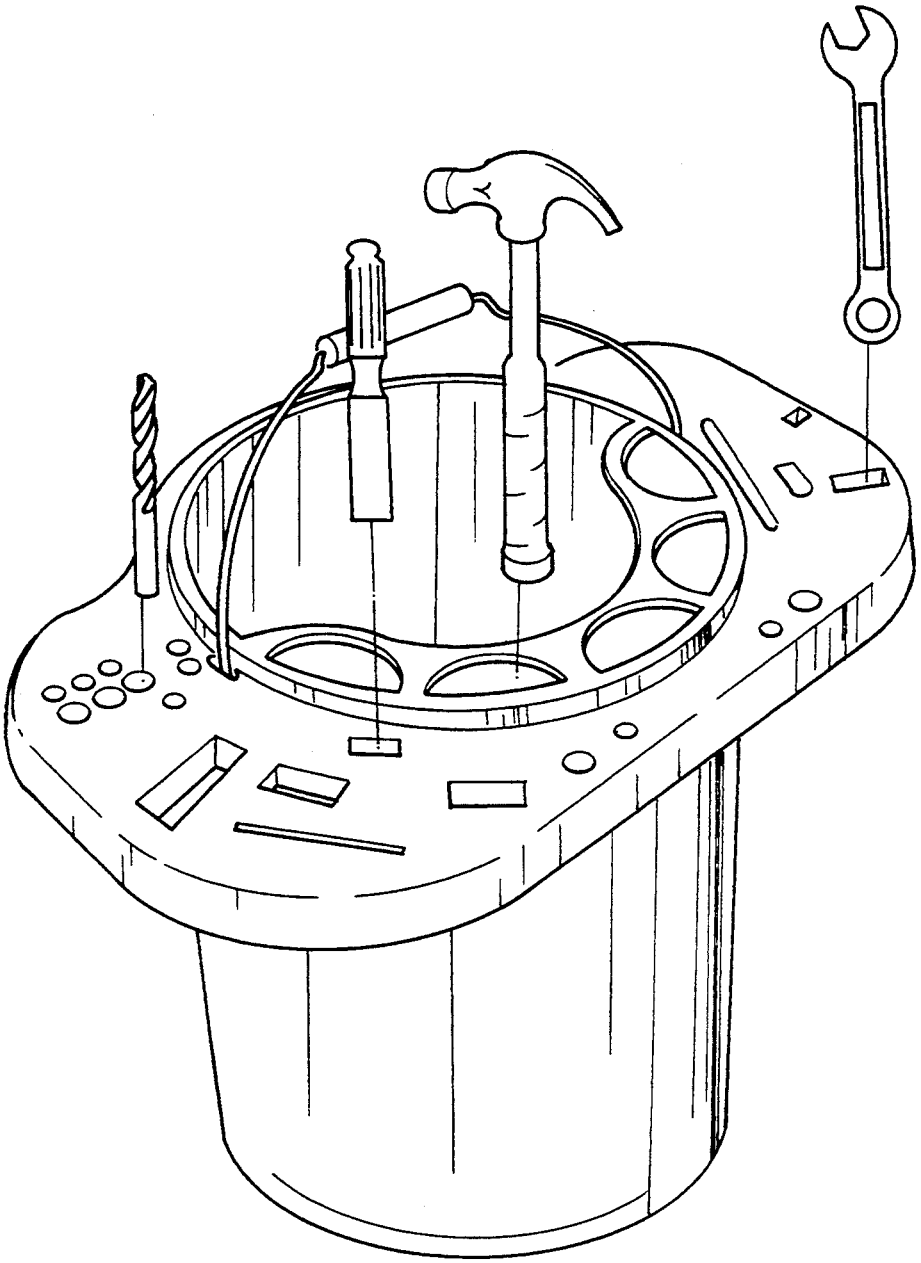
Fig.1 PRIOR ART
FIG. 1 shows a tool carrier mounted on a bucket.
Figure 2:
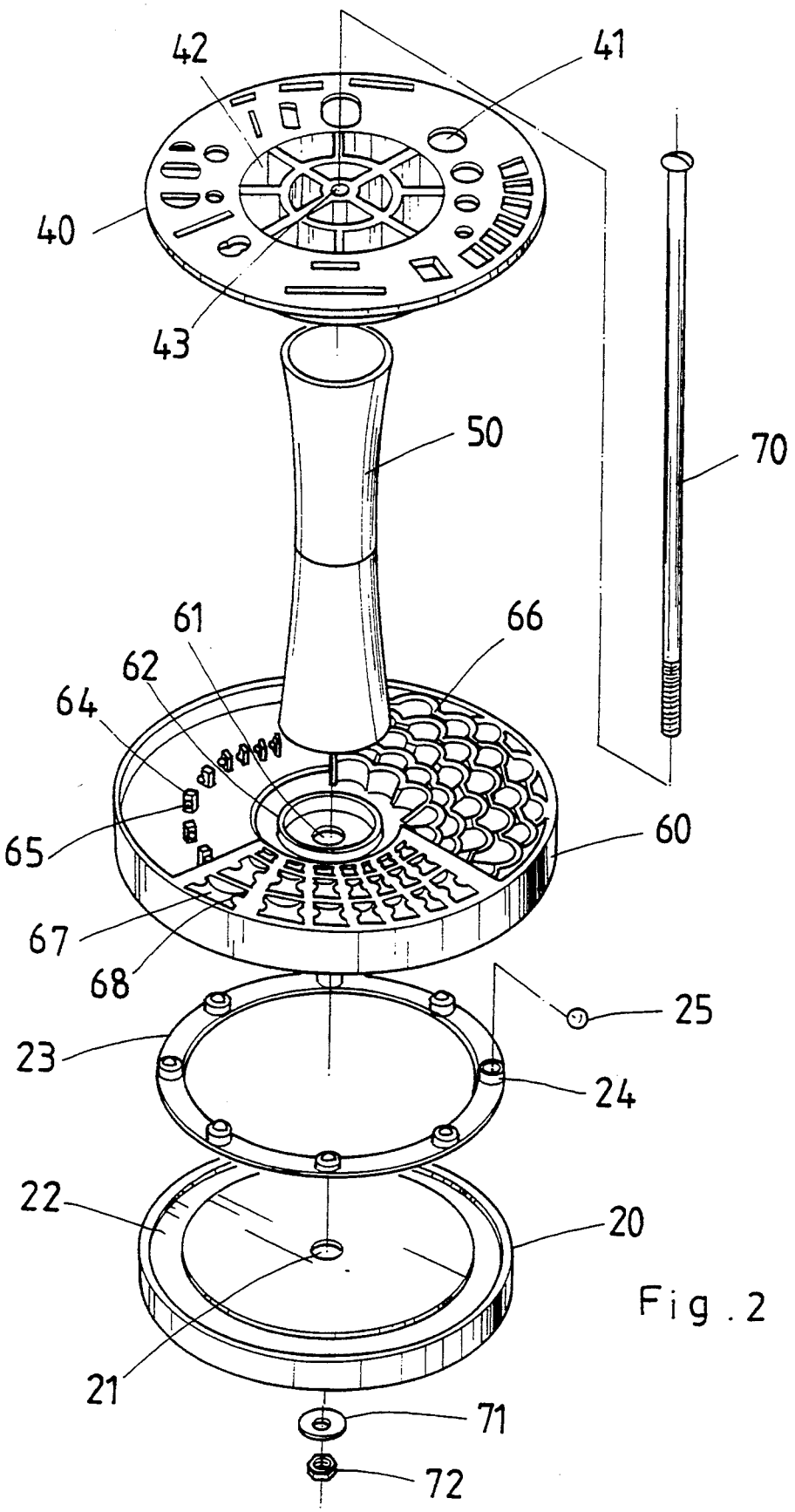
FIG. 2 is an exploded view of a rotary tool carrier assembly according to the preferred embodiment of the present invention.
Figure 3:
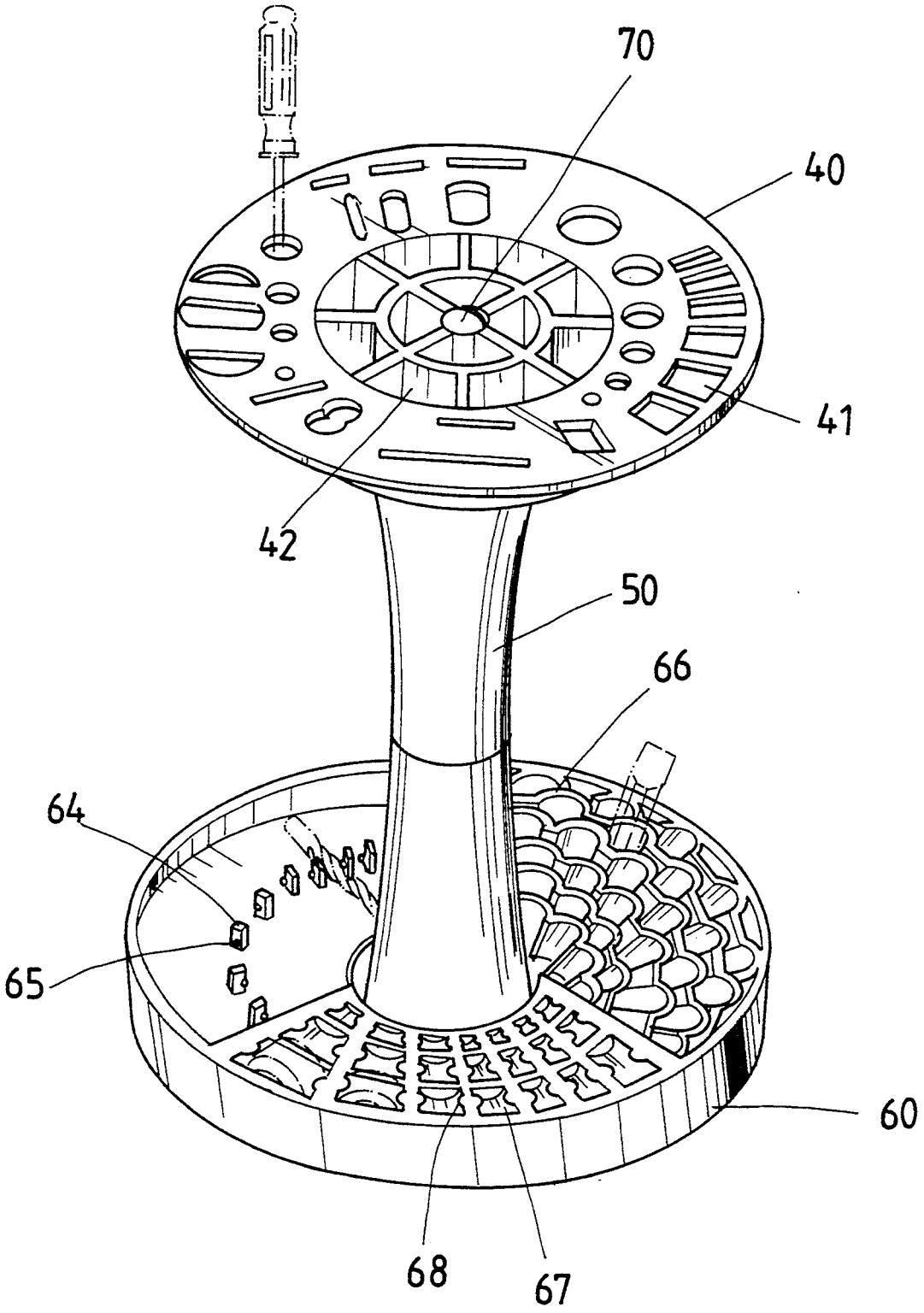
FIG. 3 is an elevational view of the rotary tool carrier assembly of FIG. 2.
Figure 4:
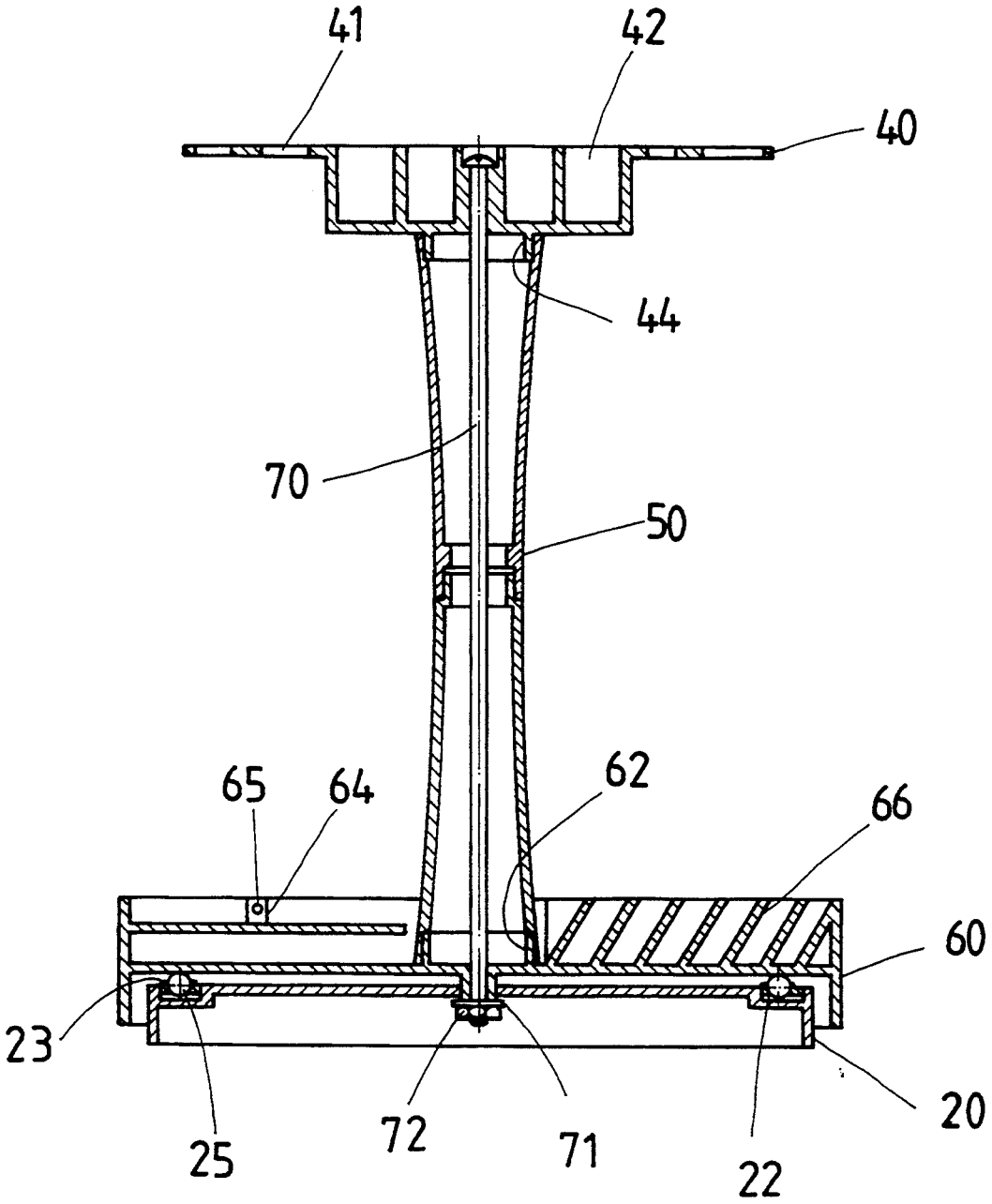
FIG. 4 is a longitudinal view in section of the rotary tool carrier assembly of FIG. 3.

Referring to FIGS. 2, 3, and 4, a rotary tool carrier assembly in accordance with the preferred embodiment of the present invention is generally comprised of a base 20 and a tool carrier unit fastened together by a screw bolt 70, a washer 71, and a locknut 72. The tool carrier unit is comprised of a bottom carrier 60, a hollow upright support 50, and a top tool carrier 40. The top tool carrier 40 includes a through hole 43 in the center, a plurality of storage chambers 42 spaced around the center through hole 43 for keeping screws and nuts and other small accessories, a variety of hanging holes 41 spaced around the border for hanging different hand tools, and an annular bottom flange 44 fitted into the top of hollow upright support 50. The hollow upright support 50 consists of two tubular sections supported between the top tool carrier 40 and the bottom tool carrier 60. The bottom tool carrier 60 includes a center through hole 61, an annular top flange 62 fitted into the bottom of hollow upright support 50, a series of upright stop rods 64 with raised portions 65 respectively spaced from one another for holding a set of drill gimlets in the gaps defined between, a plurality of linked cells 66 sloping outwardly upward for keeping a variety of tool bits, a series of recessed holes 67 made gradually deeper toward one end for keeping a variety of sockets, wherein each recessed hole 67 has two symmetrical projecting strips 68 at two opposite sides for holding a socket in the respective recessed hole 67. The base 20 is relatively smaller in diameter than the the bottom tool carrier 60, and includes a center through hole 21 and an annular groove 22 around the border. There is provided a ball race 23 fitted into the annular groove 22 on the base 20 to support the bottom tool carrier 60 by steel balls 25 in equally spaced holes 24 thereof.

Referring to FIG. 4 again, the screw bolt 70 is inserted through the center through hole 43 on the top tool carrier 40, the hollow upright support 50, the center through hole 61 on the bottom tool carrier 60, the ball race 23, and the center through hole 21 on the base 20, and then secured with a locknut 72 and a washer 71 retained between the locknut 72 and the base 20. When assembled, the bottom tool carrier 60 is supported on the steel balls 25 of the ball race 23 and spaced above the base 20, and therefore the tool carrier unit can be turned on the base 20 in either direction.

While only one embodiment of the present invention has been shown and described, it will be understood that various modifications and changes could be made without departing from the spirit and scope of the invention.

I claim:

1. A rotary tool carrier assembly comprising:

a) a base including a top portion, an annular groove formed in the top portion, and a ball race disposed within the annular groove;

b) a tool carrier unit secured to the base for rotation relative to the base, the tool carrier unit including a bottom tool carrier supported on the ball race, a top tool carrier and an upright support connecting the bottom and top tool carriers;

c) the top tool carrier including a plurality of holes for hanging tools and a plurality of chambers for storing fasteners; and d) the bottom tool carrier including a plurality of spaced upright stop rods for holding drill gimlets within the spaces defined therebetween, the stop rods being provided with raised portions for retaining the drill gimlets within the spaces, a plurality of linked sloping cells for maintaining different tool bits, and a plurality of recessed holes formed gradually deeper toward one end for maintaining different sockets, and each recessed hole having a pair of projecting strips for retaining a socket therein.

2. The rotary tool carrier assembly of claim 1 wherein the ball race includes a plastic ring having a top portion, a plurality of holes equally spaced around the border of the top portion, and a plurality of steel balls disposed within the holes for supporting the bottom tool carrier above the base.

* * * * *